US006821039B2

(12) United States Patent
Lewis

(10) Patent No.: US 6,821,039 B2
(45) Date of Patent: Nov. 23, 2004

(54) PRINTING APPARATUS AND METHOD

(75) Inventor: Richard H Lewis, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/285,353

(22) Filed: Oct. 30, 2002

(65) Prior Publication Data

US 2004/0085425 A1 May 6, 2004

(51) Int. Cl.[7] ..... B41J 2/21
(52) U.S. Cl. ..... 400/649; 400/648; 347/104
(58) Field of Search ..... 400/648, 649, 400/659; 101/42, 43; 347/38, 104

(56) References Cited

U.S. PATENT DOCUMENTS 5,136,938 A * 8/1992 Pellegrina ..... 101/115
5,517,223 A * 5/1996 Shin ..... 347/38

FOREIGN PATENT DOCUMENTS

| | | | | |
|---|---|---|---|---|
| GB | 2107255 A | * | 4/1983 | ..... B41F/1/38 |
| JP | 06313960 A | * | 11/1994 | ..... G03D/13/00 |
| JP | 2000127344 A | * | 5/2000 | ..... B41F/15/08 |
| JP | 2001242678 A | * | 9/2001 | ..... G03G/15/01 |

* cited by examiner

*Primary Examiner*—Daniel J. Colilla

(57) ABSTRACT

A printing device comprising a plurality of drums each arranged to support a print media sheet, said device being arranged to transport said drums in a predetermined order around a closed path comprising a plurality of print positions, said device being arranged to print at each print position with a different inkjet print bar, said device being further arranged to rotate a drum located in a print position relative to said corresponding print bar to allow said print bar to incrementally print over the surface of a sheet supported on said drum.

29 Claims, 5 Drawing Sheets

PRINTING APPARATUS AND METHOD

FIELD OF THE INVENTION

The present invention relates generally to hardcopy devices and methods, particularly but not exclusively to inkjet printers and to methods of operating such devices.

BACKGROUND TO THE INVENTION

As is well known in the art, conventional inkjet printers generally employ one or more inkjet cartridges, often called "pens", which eject drops of ink onto a page or sheet of print media. For instance, two earlier thermal ink ejection mechanisms are shown in U.S. Pat. Nos. 5,278,584 and 4,683,481, both assigned to Hewlett-Packard Company. Historically, the pens have usually been mounted on a carriage, which is arranged to scan across a scan axis relative to a sheet of print media as the pens print a series of individual drops of ink on the print media. The series of drops collectively form a band or "swath" of an image, such as a picture, chart or text. Between scans, the print medium is advanced relative to the scan axis. In this manner, an image may be incrementally printed.

Over recent years the importance placed on the throughput of inkjet printers has risen dramatically. Throughput is generally measured as the number of pages of a given size, or the area of print media that a printer may ink in a given time.

One approach to increasing the throughput of such printers is to use one or more static arrays of print nozzles which span the width of pages to be printed on. Pages of print media may then be loaded onto a belt or a drum and transported under successive page wide arrays of print nozzles, or print bars. Although such page wide array systems offer the possibility of increased throughput, they suffer from certain disadvantages.

Both belt and drum based page wide array systems may be bulky, making them unsuitable for certain operating environments. Because of the possibility of air locks obstructing inkjet nozzles, inkjet nozzles generally only function correctly in a certain range of orientations; i.e. when they are arranged to eject ink broadly downwards. In practice, this means that the print bars are located above a belt or drum in order to ensure that they are correctly orientated. Usually, at least one print bar is required for each ink colour which is to be printed. Conventionally, this includes at least cyan, magenta, yellow and black. In practice though further print bars may be required for redundancy reasons, or to print further coloured inks, or a fixer substance. These factors, therefore, necessitate a large belt or drum that provides sufficient space for all of the print bars to be suitably positioned relative to the belt or drum.

At the same time, page wide array systems also require a high degree of precision in their feed paths in order to ensure satisfactory print quality results. This can be difficult or costly to achieve in the case of large drum and belt based page wide array systems.

It would therefore be desirable to provide a printing device and method, which addresses the problems found in the prior art.

SUMMARY OF THE INVENTION

According to one aspect of the present invention there is provided a printing device comprising first and second platens each arranged to support a media sheet, and first and second print stations having first and second print positions respectively, said device being arranged to index said platens in a predetermined order from said first to said second print position, said device being further arranged to advance a platen located in a print position relative to said corresponding print station such that said corresponding print station may print on different areas of a sheet supported on said platen, said indexing motion and said advance motion being independently controllable.

Advantageously, this aspect of the invention decouples media advance movement and media indexing movement. That is to say that the movement that feeds print media relative to a given print bar, for example, allowing that print bar to incrementally print across the printable surface of the sheet, may be controlled separately from that which feeds print media from one print bar to the next. Thus, for example, the media advance movement may be zero when the media is being indexed and vice versa.

Various advantages follow from the configurations of printer devices according to this aspect of the invention. Firstly, smaller platens may be used. In one preferred embodiment, drum platens are used. By separating the required print bars in a page wide array system and indexing, or moving the drums from one print station to another, fewer print bars need print on a given sheet at any given time. Thus, the space required by print bars at any given print station is reduced allowing the use of smaller diameter drums.

Preferably, the drums are as small as possible such that the largest sheet for which the printer is designed to function may just fit on to an individual drum. By using small drums various further advantages are realised. Unlike a large drum, it is relatively easy and inexpensive to fabricate small drums of high tolerance. These may be manufactured using conventional manufacturing techniques, such as injection moulding. Small drums of this sort may have more inherent rigidity than corresponding larger drums. Furthermore, smaller drums may be more easily driven due to lower total inertia. At the same time, small drums offer various advantages over belts for use in page wide array systems, for example. They offer significantly better control over media handling. Higher media hold down forces, such as vacuum forces, may generally be obtained to hold the print media to the surface of a drum than of a belt. Additionally, a drum does not encourage print media to oscillate in an axial direction as it is fed in the media advance direction in the manner that belts have a tendency to do. Furthermore, a drum generally allows the distance between the writing head of a print station, for example an inkjet head, and the print medium to be more accurately maintained. This in turn often allows faster printing speeds to be achieved.

In a preferred embodiment of the present invention, a given sheet is supported on a single drum throughout the process in which it is printed on. This enables the sheet to be more securely held, which reduces the risk of movement between the sheet and the platen or drum of the printer. Thus, the likelihood of print defects, such as registration defects, is also reduced. It will be understood that a printing process may comprise the printing of several colour separations and the application of fixer, which may be applied by a print bars, for example, located at a number of print stations.

Preferably, the advance motion of the platen relative to said corresponding print station is arranged such that the corresponding print station may print over substantially the whole printable area of the sheet supported on said platen in one continuous operation. This may allow for relatively rapid printing with correspondingly high levels of throughput.

A further advantage which follows from the configurations of printer devices according to this aspect of the invention is that the number of print passes which may be made with each print bar over a give sheet of print media may to be controlled in a flexible way. In the case of a preferred embodiment of the invention two or more drums platens are used. In such an embodiment, the media advance movement may be provided by causing the drums to rotate about their own longitudinal axes. The media indexing movement may be provided by causing an assembly of drum platens to rotate about a central hub, to successively bring the drums to printing positions adjacent to different print bars. In this manner, by varying the number of media advance revolutions made by the drums in between successive indexing movements, the number of print passes may be varied. Alternatively, if the platens follow a closed loop indexing path, selected sheets may pass around the indexing path one or more times. Each extra time the sheets pass around the path, the number of passes is increased.

Furthermore, the same methods of altering the pass number may alternatively or instead be used to provide redundancy for the print bars. This approach to redundancy may be beneficial in terms of hardware cost and space constraints when compared to the conventional use of duplicate print bars.

The present invention extends to the corresponding method. In another aspect, the present invention also extends to a computer program, arranged to implement the method of the present invention.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described examples of the best mode contemplated by the inventors for carrying out the invention.

First Embodiment

Figure 1A:
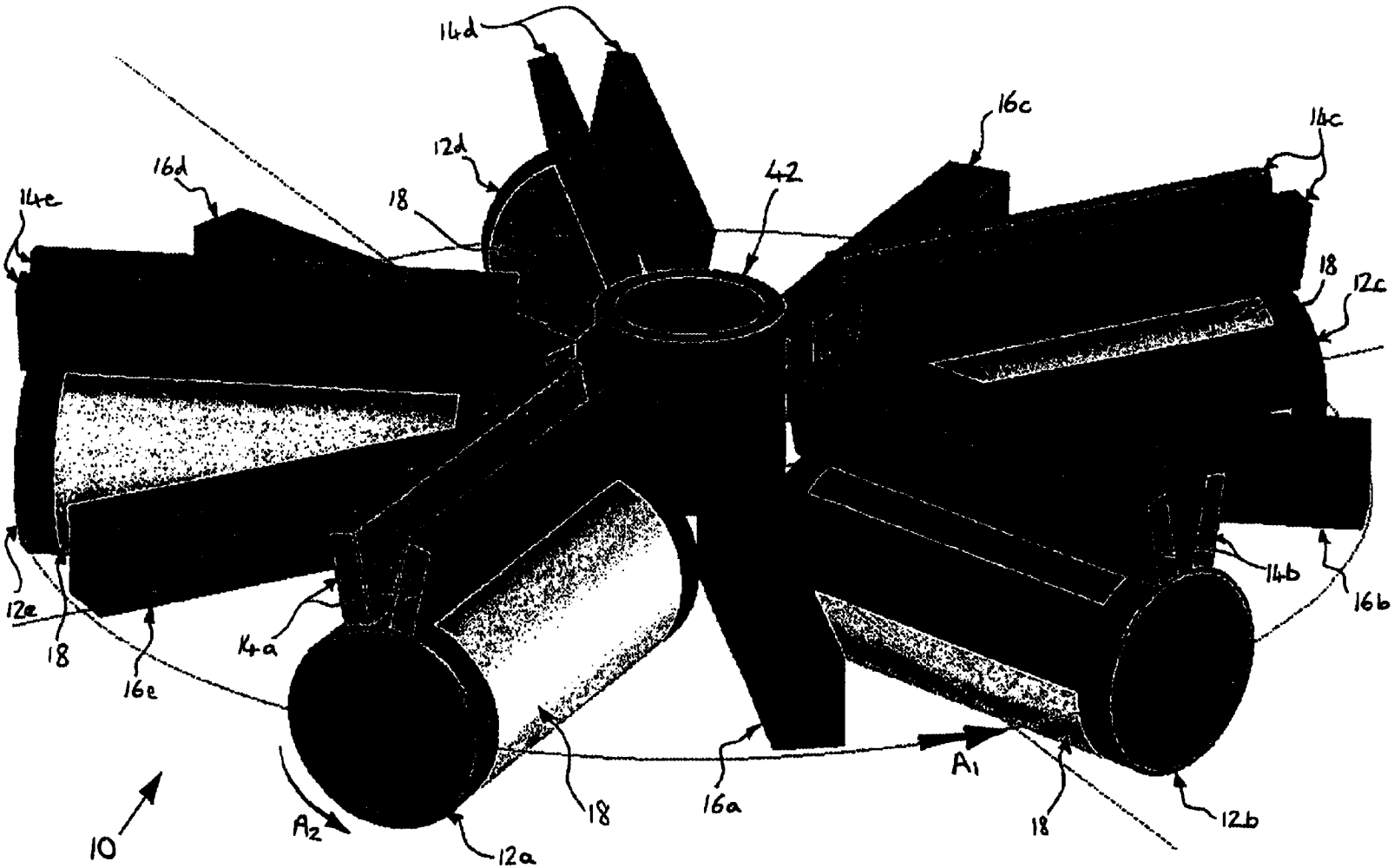
FIG. 1*a* is a schematic perspective partial view of an inkjet printer according to a first embodiment of the invention.
Figure 1B:
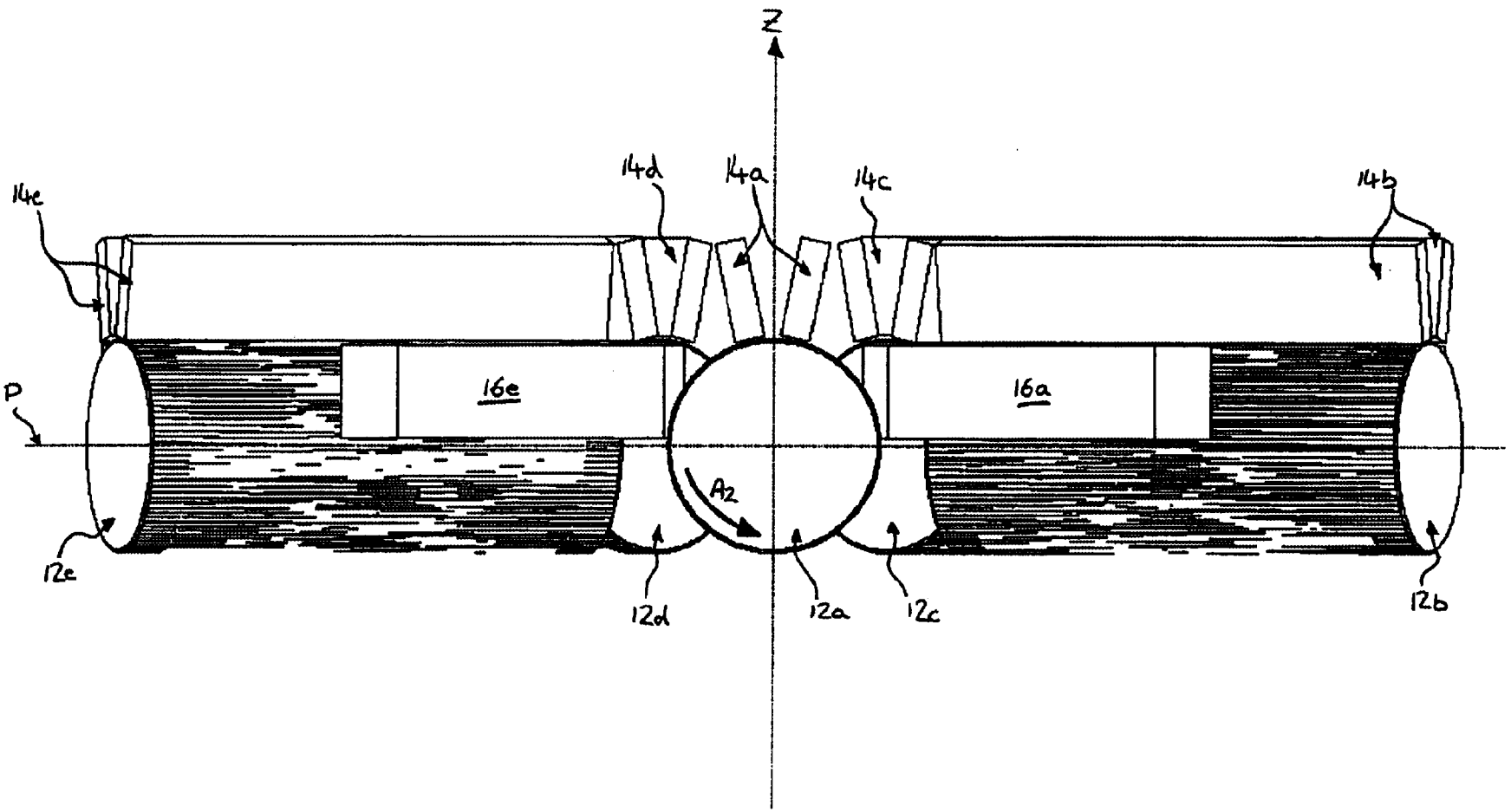
FIG. 1*b* is an elevation view of the components of the inkjet printer shown in FIG. 1*a;*
Figure 1C:
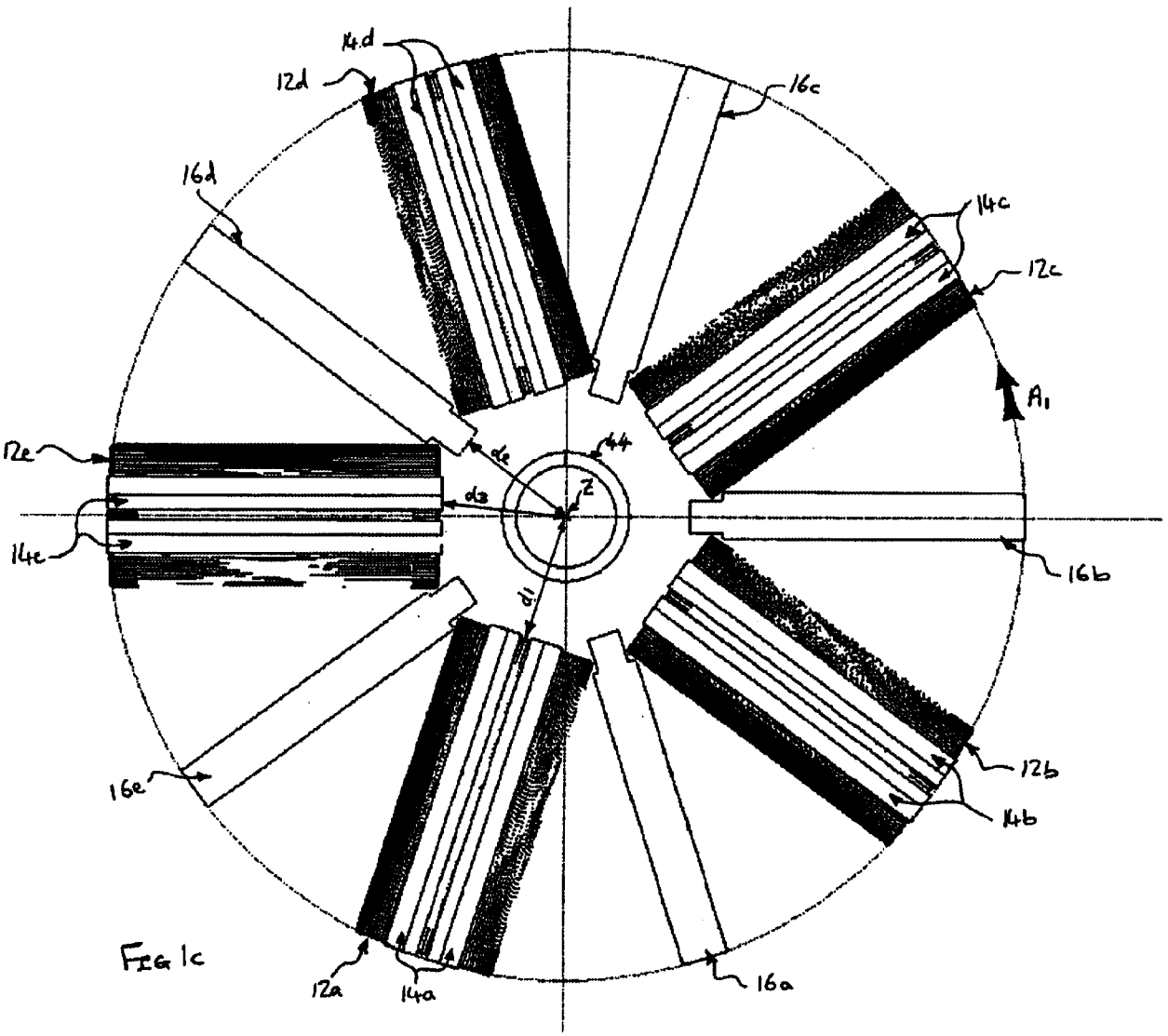
FIG. 1*c* is a plan view of the components of the inkjet printer shown in FIG. 1*a;*

Referring to FIGS. 1*a–c,* an inkjet printer 10 of an embodiment of the invention will now be described. FIG. 1*a* is a schematic perspective partial view of an inkjet printer according to the present embodiment of the invention. For the sake of clarity, various components of the printer have been omitted. However, as can be seen from the figure, five drum platens 12*a–e* are illustrated. Also illustrated in the figure are five pairs of print bars 14*a–e* and five service stations 16*a–e.*

In the present embodiment, each of the drums 12*a–e* has the same dimensions. The drums are located in a plane "p", arranged about the vertical axis "z" of the printer. Plane "p" is illustrated in FIG. 1*b,* which is an elevation view of the components of the inkjet printer shown in FIG. 1*a* and in which the plane "p" is illustrated lying perpendicular to the page. The vertical axis "z" of the printer is illustrated in FIG. 1*b* and also FIG. 1*c,* which is a plan view of the components of the inkjet printer shown in FIG. 1*a.* As can be seen from the figures, the drums 12*a–e* radiate out from the vertical axis "z" of the printer at regular angular intervals and are located a common distance "$d_1$" from it. Each of the drums 12*a–e* are adapted to support a sheet of print media 18, illustrated in FIG. 1*a,* as will be described in more detail below, and may be manufactured using conventional manufacturing techniques, such as plastic injection moulding. The sheets of print media may be paper based. However any other suitable type of print media may also be used; for example, transparencies, Mylar™, and the like.

As can be seen from FIGS. 1*a–c,* the five service stations 16*a–e* are arranged in a similar manner to the drums 12*a–e;* i.e. they radiate out from the vertical axis "z" of the printer at regular angular intervals and are similarly located a common distance "$d_2$" from it. Thus, in the present example, one service station lies equidistant between each pair of adjacent drums. In the present embodiment, the relative positions of the drums and the service stations are fixed by a rigid supporting structure (not shown). As will be described below, the drums and the service stations are arranged to rotate in use as a unit about the vertical axis "z" of the printer.

As can be also be seen in the FIGS. 1*a–c,* the five pairs of print bars 14*a–e* are also arranged in a similar manner to the drums 12*a–e;* i.e. they radiate out from the vertical axis "z" of the printer at regular angular intervals and are similarly located a common distance "$d_3$" from it. As will be apparent from the following description, each of the distances "$d_1$", "$d_2$" and "$d_3$" are selected in the present embodiment such that the working lengths of the print bars, drums and service stations are correctly positioned relative to one another in use.

In the present embodiment, the print bars are made up of conventional thermal inkjet printheads, although other types of printheads may be used, such as piezoelectric printheads. The structure and operation of such printheads, and indeed print bars made up from such printheads, will be well understood by the skilled reader and so will not be described here further. However, examples of print bars suitable for use in the present embodiment are disclosed in: U.S. Pat. No. 6,428,145 B1, entitled "Wide-array inkjet printhead assembly with internal electrical routing system"; U.S. Pat. No. 5,719,602 A1, entitled "Controlling PWA inkjet nozzle timing as a function of media speed"; and, U.S. Pat. No. 5,734,394 A1, entitled "Kinematically fixing flex circuit to PWA printbar". Each of these references is in the name of Hewlett-Packard Co. and is hereby incorporated by reference in its entirety.

In the present embodiment, the pair of print bars 14*a* is arranged to print a conventional fixer liquid, whilst each of the remaining pairs of print bars 14*b–e* is arranged to print a different one of the coloured inks cyan, magenta, yellow and black. In the present embodiment the pair of print bars 14*b,* 14*c,* 14*d* and 14*e* print cyan, magenta, yellow and black ink, respectively. The inks are dye-based inks although other inks such as pigment based ink could alternatively or additionally be used.

In this embodiment, the five pairs of print bars are each arranged to be held in a fixed position relative to the chassis (not shown) of the printer. Thus, the assembly including the drums and the service stations may rotate relative to the print bars. It will of course be understood that in other embodiments the drums and/or the service stations could be held stationary and the print bars arranged to rotate. Thus, it will be seen that each pair of print bars 14*a–e* forms a separate print station, which may be used to print at a substantially different location and/or under separate control from the remaining print stations.

Figure 2:
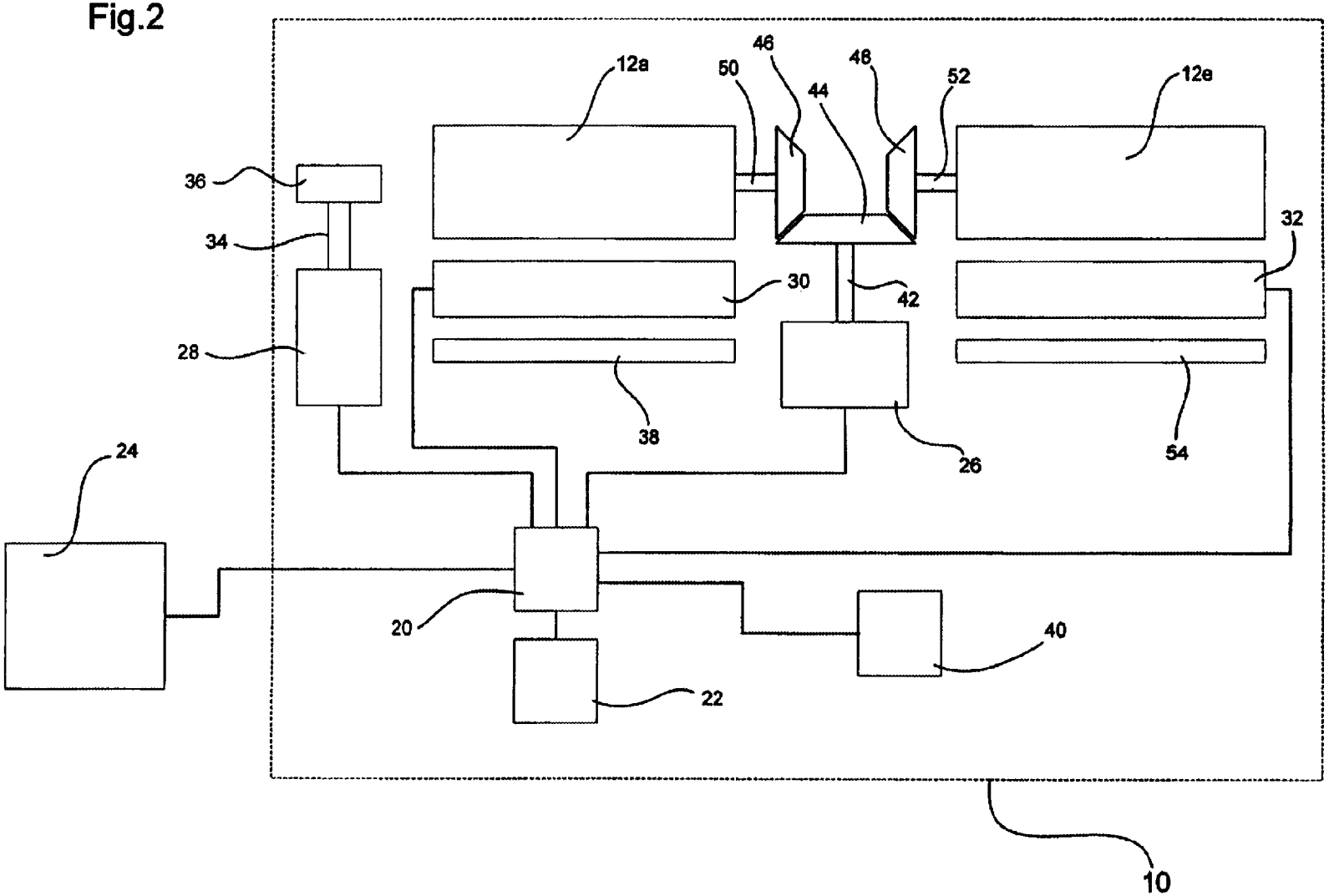
FIG. 2 is a high level functional block diagram of the inkjet printer according to the first embodiment of the invention.

The printer 10 also has a print controller, illustrated schematically as a controller 20. This is illustrated in FIG. 2, which is a high level functional block diagram of the printer 10 and illustrates the relationship between selected hardware elements of the printer. The controller 20 receives instructions from a host device 24, which is typically a computer, such as a personal computer or a computer aided drafting (CAD) computer system. The printer controller 20 may also operate in response to user inputs provided through a user input device, such as a keypad or status display portion (not shown). Such user input devices are generally located on the exterior of the casing (not shown) of the printer. The printer controller 20 has associated memory 22, which may include ROM, RAM and a non-volatile data storage module, such as a high capacity hard disk drive. Image data, which is downloaded from a host device, may be stored in the RAM prior to being printed. The ROM stores operating instructions, which the controller 20 accesses in order to carry out the functions of the printer.

As can be seen from the figure, the controller 20 is also connected to an advance motor 26, an indexing motor 28, a sheet picking system 30, a sheet ejecting system 32 and a vacuum hold down mechanism 40.

When a printing operation is initiated, (i.e. once the printer 10 has received image data to print and has carried out any necessary routines prior to printing) the controller 20 actuates the indexing motor 28 to rotate the assembly of drums and service stations in the counter-clockwise direction about the Z-axis, as viewed in FIG. 1*a*. This is indicated in FIGS. 1*a* and 1*c* by the arrow "$A_1$". In FIG. 2, the incrementing motor 28 is schematically illustrated as being arranged to rotate the assembly of drums and service stations by driving a gear 36 via a drive shaft 34 and further drive train (not shown), such as a belt. However, any other suitable drive mechanism may instead be used.

The controller 20 continues to drive the incrementing motor 28 until a selected drum is correctly positioned to receive a new blank sheet of print media from the sheet picking system 30. It is assumed in the case of this example that at this stage none of the drums are loaded with print media. In FIG. 2, the selected drum is referenced 12*a*. As is illustrated in FIG. 1*a,* in this embodiment the position in which the drum 12*a* is positioned to receive a new blank sheet of print media from the sheet picking system 30 is directly below the pair of print bars 14*a*. It will be noted that when drum 12*a* is located directly below the pair of print bars 14*a,* each of the remaining drums 12*b–e* are located directly below the pairs of print bars 14*b–e,* respectively. This position of the drums relative to the print bars may be termed a "print position" or an "indexing position". It will be appreciated that due to the rotational symmetry which exists between the assembly of drums and the assembly of print bars, five such "print positions" or "indexing positions" exist.

Preferably, the assembly of drums and service stations is arranged to rotate relative to a guide structure (not shown). Such a guide structure may be arranged to support at least part of the weight of the assembly of drums and service stations; thus ensuring that the drums and service stations may be accurately maintained in the plane "p". Additionally or alternatively, it may serve to correctly position the assembly of drums and service stations at predetermined angular positions. The guide may position the assembly of drums and service stations using conventional mechanical engineering techniques familiar to the skilled reader. Using such techniques, the drum and service station assembly may be brought to one of a range of precise positions relative to the pairs of print bars. These position may be any one of the five indexing positions. In the same way, the service stations may also be brought to a precise (static) position relative each pair of print bars; for example immediately below a pair of print bars to allow a servicing routine to be performed, as will be described in more detail below.

Under the control of the controller 20, the picking system, which may be of conventional design, picks a sheet of print media from a stack of such media held in an input tray 38. The picked sheet is then presented to the adjacent drum 12*a*. In order that the sheet is correctly loaded on to the drum and held on the drum surface, the controller causes the drums to rotate about their longitudinal axis. In the case of drum 12*a,* this is illustrated by the arrow "$A_2$" in FIGS. 1*a* and 1*b*. Additionally, the controller actuates the vacuum hold down mechanism 40. The vacuum hold down mechanism causes a partial vacuum in the inside of each of the drums. In a conventional manner, a vacuum force is transmitted to the surface of the sheet, in contact with the surface of the drum via a number of vacuum apertures in the drum surface. The skilled reader will appreciate that alternative hold down systems may also be used. For example, electrostatic based hold down systems. Furthermore, if desired, a conventional edge clamping system may be incorporated in the drum, to secure the leading edge of the media sheet whilst it is loaded onto and supported on the drum. Thus, the sheet may be entrained onto the drum 12*a* in a conventional manner. The sheet may then be retained on the surface of the drum in this manner until it is removed on completion of the printing operation, as described below.

The drums are driven to rotate about their longitudinal axes by the advance motor 26 under the control of the controller 20. It can be seen from FIG. 2 that the advance motor 26 is arranged to drive a 45 degree bevelled gear 44 via a drive shaft 42. The bevelled gear 44 and the drive shaft 42 are also schematically illustrated in FIGS. 1*c* and 1*a,* respectively. The bevelled gear 44 engages and drives five further bevelled gears; each of the five further bevelled gears being mounted on a drive shaft associated with a different one of the five drums. However, for the sake of clarity, only two of the five drums are illustrated in FIG. 2; drums 12*a* and 12*e*. The drum 12*a* is driven via a bevelled gear 46 and a drive shaft 50. The drum 12*e* is driven via a bevelled gear 46 and a drive shaft 52. It will thus be appreciated that in the present embodiment, the advance motor 26 drives each of the five drums simultaneously and in the same direction at any given time.

In the present embodiment, the drums 12*a–e* have a circumference which is just longer than the corresponding dimension of the biggest sheet of print media for which the printer is designed, when it is fully entrained about a drum. In this manner, the entire surface of a sheet may be held in contact with the surface of the drum by virtue of the vacuum hold down system. At the same time, the size of the drums, and thus the overall size of the printer, may be kept to a small volume.

As will be understood by the skilled reader, where page wide array inkjet printers are used to print with a high throughput, one problem which may arise is to how to dry the large quantities of ink and fixer which are rapidly deposited onto the print media. In the present embodiment, the drums are heated electrically, using conventional heating techniques. In this manner, the sheets may be substantially dry when they are stripped from the drums by the sheet ejecting system 32 at the end of the printing process.

In the present embodiment, whilst the picked sheet passes under the pair of print bars 14*a* as it is being loaded on to the drum 12*a,* the pair of print bars 14*a* print a conventional ink fixer chemical on to the surface of the sheet. This is carried out under the control of the controller. The required distribution and density of the fixer chemical across the surface area of the sheet may vary with operational requirements and the image to be printed on that sheet. However, this is implemented using conventional inkjet printing techniques; i.e. the controller outputs firing signals to the pair of print bars 14*a* causing the nozzles of the print bars to selectively fire at the appropriate times as the drum 12*a* rotates to deposit fixer at the desired locations on the sheet of print medium. In the present embodiment, the nozzles of the print bars span the length (along the longitudinal axis) of an adjacent drum located in the indexing position. Thus, the print bars may print a swath or line across the whole width (in the direction of the longitudinal axis of the drum) of a sheet of print media loaded on the drum. As the drum rotates about its own longitudinal axis, the different areas of the sheet of print media are exposed to be printed on. In this manner, drops of ink or fixer, depending upon the printing station, may be printed at any desired location on the sheets of print media.

Once the sheet has been fully entrained onto the drum 12*a* and the required fixer has been applied to the surface of the sheet, the controller implements an indexing procedure. In the present embodiment, the drums are not driven about their longitudinal axis during indexing procedures: i.e. the drums are held in a fixed rotational position (about their own longitudinal axes) by the advance motor 26 in between print operations. However, in other embodiments, the drums may be driven about their longitudinal axis both during printing and during indexing procedures. In this manner, they may be continuously driven about their longitudinal axes. This may lead to a reduction in the complexity of operation of the printer. Furthermore, this may allow for faster throughput, by obviating the need to delay each printing operation until the drums are accelerated to their rotational printing velocity.

Again the controller 20 actuates the indexing motor 28 to rotate the assembly of drums and service stations in the counter-clockwise direction as viewed in FIG. 1*a*. The assembly of drums and service stations is rotated 72 degrees to the next indexing position.

Typically, in order to ensure satisfactory print quality in inkjet systems, service routines are periodically carried out on inkjet printheads before and during use. In the present embodiment, such routines are carried out under the control of the controller, whilst a service station is located beneath the print bars that require servicing. It will be appreciated that in carrying out the indexing procedure each of the service stations 16*a–e* passes directly underneath a different print bar. For example, in the present indexing procedure, the service station 16*a* passes directly below the pair of print bars 14*b*. Thus, if the controller determines that selected nozzles of any of the print bars require a servicing routine prior to their next printing operation, this may be carried out whilst a service station is below that print bar.

In the present embodiment, the service stations 16*a–e* include one or more reservoirs, termed "spittoons" which are designed to receive and store drops of ink ejected during "spitting" operations. "Spitting" is the term given to the process by which a number of ink drops are fired through one or more nozzles of a printhead in order to remove a blockage in the nozzle caused by dried ink or other matter. In this embodiment, the controller causes selected nozzles to spit as a spittoon of a given service station passes below them. In the present embodiment the spitting operations are carried out whilst the service stations are rotating beneath them, as opposed to stopping the indexing procedure during a servicing routine. This ensures that the indexing procedures may be implemented rapidly. However, in other embodiment, the indexing procedures may be stopped as required, such that the service stations remain stationary beneath the print bars. This may allow a more complete servicing routine to be implemented. This may possibly involving further servicing activities including wiping or capping of the nozzles for example.

Unlike the drums, the service stations in the present embodiment are located above the plane "p" as is illustrated in FIG. 1*b*. In this way, the upper surface of the service stations lie a similar distance from the lower surface of the print bars as do the uppermost points of the drums. This means that the gap between the print bars and the service stations is kept to a small distance. This may help to reduce the effect of aerosol particles which may be generated during spitting routines. At the same time, the service stations do not interfere with the print bars as the service stations rotate relative to the print bars. Consequently, the service stations do not need not be raised or lowered relative to the print bars before, during or after servicing routines. Thus, servicing routines may be efficiently implemented without the need for complex mechanisms to position the service stations relative to the print bars.

Any servicing routines stop as servicing stations pass beyond the positions at which spitted ink will be caught by spittoons. The assembly of drums and service stations then continues rotating until it reaches the next indexing position. In this example, the drum 12*a* is positioned below the pair of print bars 14*b*. It will be noted that in this position, the remaining drums 12*b,* 12*c,* 12*d* and 12*e* are now located directly below the pairs of print bars 14*c,* 14*d,* 14*d* and 14*a,* respectively. In this position the printer is ready to carry out a printing operation with the pair of print bars 14*b* on the sheet supported on the drum 12*a*. Similarly, in this position a second sheet of print media may be loaded onto drum 12*e* by the sheet picking system 30, if the print job currently being undertaken requires it.

The controller once again actuates the advance motor 26, which causes each of the five drums to rotate about their longitudinal axes simultaneously. The controller outputs firing signals to the pair of print bars 14*b* in a conventional manner. This causes the nozzles of the print bars 14*b* to selectively fire at the appropriate times, thus depositing cyan ink at the desired locations of the first sheet of print medium, supported on the drum 12*a*. At the same time, a second sheet of print media is loaded by the sheet picking system 30, in this case onto drum 12*e*. Fixer is also applied to the second sheet. Both the loading of the second sheet and the application of the fixer to it is carried out in the same manner as was described above with reference to the loading of the first sheet on to the drum 12*a*.

Since the drums rotate at the same angular velocity, the application of fixer by the pair of print bars 14*a* to the second sheet starts and finishes at the same instants as the application of cyan ink to the first sheet by the pair of print bars 14*b*. In the present embodiment, this is upon the completion of a full revolution of the drums. Thus, when the drums have finished the complete revolution, the controller 20 again actuates the indexing motor 28 to carry out a further indexing procedure. Again, the assembly of drums and service stations rotate relative to the print bars in the counter-clockwise direction as viewed in FIG. 1*a,* as is described above. In this manner, the second colour ink (magenta) may be applied to the first sheet held on the drum 12*a,* the first colour ink (cyan) may be applied to the second sheet held on the drum 12*e* and a third sheet of print media may be loaded onto the drum 12*d* and may receive fixer from the print bars 14*a*. As is described above, the controller may cause selected nozzles of any of the print bars to spit into the service station which passes beneath it during the indexing procedures.

Each picked sheet progresses around the printer in this manner in a series of alternating print and indexing operations. With each successive print operation, a further ink is added to each sheet, thus progressively building up a full colour image. It will be understood by the reader that at each print operation a new sheet is picked and loaded onto the drum adjacent to the sheet picking system 30, whilst there remain further pages to print in the current print job, or indeed of a further print job.

When a sheet has undergone a printing operation under each of the print bar pairs 14*a, b, c* and *d,* where it may have received fixer, cyan, magenta and yellow ink respectively, it arrives at the fifth print station to receive black ink from the pair of print bars 14*e*. Although this printing operation itself follows the same format as the preceding printing operations, the sheet is progressively stripped from the roller that is supporting it as it is printed on. In the present embodiment, this stripping process is carried out by a conventional sheet ejecting system 32, which is schematically illustrated in FIG. 2. In the present embodiment, the sheet ejecting system 32 comprises a number of "fingers". The fingers are adapted to run in grooves in the outer circumferential surface of the drum located adjacent to the fifth print station. The fingers lift the sheet from the surface of the drum, despite the vacuum pressure exerted on the sheet by the vacuum system 40. It will however be understood that any other suitable sheet ejecting system or mechanism may instead be employed. The sheets that are stripped from their supporting drums are forwarded to an output position, such as the output tray 54, which is also schematically illustrated in FIG. 2.

In the present embodiment, the sheet is stripped from its drum by the sheet ejecting system 32 primarily during the time the drum is being rotated about its longitudinal axis by advance motor 26; i.e. during the time that it is being printed upon by the pair of print bars 14*e*. The final part of the sheet may be stripped from its drum under the action of the drum being indexed to the following print position; i.e. adjacent to the print bar pair 14. It will however be noted that at this stage, no printing operation is being carried out on the sheet. When the drum arrives at the following print position, adjacent to the sheet picking system 30 once again, it has already had the previous sheet stripped from it by the sheet ejecting system 32. In this manner, it is then immediately ready to receive a further new sheet from the sheet picking system 30. Thus, it will be understood that for each complete revolution of the assembly of drums and service stations, each drum may support a sheet of print media which is successively printed on at each of the five print stations. In this manner, in the present embodiment, five sheets may be printed for each complete revolution of the assembly of drums and service stations.

In the print mode which is described above, each drum is rotated about its own longitudinal axis a single revolution during each printing operation. The exact rotational distance may be slightly more or slightly less than this depending upon the operational characteristics of the printer in question. These operational characteristics may include, for example: the time it takes the drums to accelerate to their printing rotational velocity; or, the degree of rotation which the drums must undergo to facilitate loading or unloading of the sheets of print media.

In the present embodiment, each sheet of print media passes under each print bar of each station once. It will be understood that in the present embodiment, each pair of print bars may be sufficient to provide a single or a two or higher pass print mode in a given pass of a sheet of print media relative to the print bars. In the former case, all of the nozzles of each print bar of a given pair may be arranged to print in different pixel locations to the nozzles of the other print bar of the pair, for example. In this way, both print bars are required to print in all potential pixel locations of the sheet. In the latter case, all of the nozzles of each print bar of a given pair may be arranged to print in the same pixel locations as corresponding nozzles of the other print bar of the pair, for example. However, in either case, the print mode of the present embodiment may be altered to provide higher pass print modes.

Taking, for example, the former case in which both print bars of a given pair are required to provide a single pass print mode in a given pass of a sheet of print media relative to the print bars. In this situation, a two pass print mode may nevertheless be achieved in the present embodiment in two ways. The first of these is to cause the drums to rotate two revolutions at each print station, in between carrying out indexing operations. In this manner, each pair of print bars may print, between them, in all potential pixel locations of the sheet two times; once during each of the two revolutions. The second way is to unload sheets of paper from their drums once the drums have been indexed twice to each desired print station. Thus, in one implementation of this method of the present embodiment, each sheet may be indexed around the printer twice, being unloaded only when it arrives adjacent to the sheet ejecting system 32 for the second time. Whilst, the first of these methods may provide a higher throughput than the second, due to fewer indexing steps being involved, the second may also be preferably in some circumstances. For example, where large quantities of ink are printed on the print media, the extra indexing steps of the second method may allow better drying of the print media.

It will be clear that either of these methods may also be used to provide three, or higher number print modes simply by increasing the number of rotations of the drums or the drum assembly, or both. Additionally, it will be clear that the same approach to increasing the number of print passes may be used in the latter case above, where all of the nozzles of each print bar of a pair are arranged to print in the same pixel locations as corresponding nozzles of the other print bar of the pair. Furthermore, due to the architecture of the printer of the present embodiment the number of passes may be dynamically changed during a print job in response to the type of pages to be printed.

Further Embodiments

It will be apparent to one skilled in the art that well known methods and structures have not been described in detail so as not to unnecessarily obscure the present invention. For example, components such as a printer casing, a user interface, ink supply modules and the like together with certain printing methods such as data processing, including steps such as halftoning, colour calibration and the like, were not described in detail in the above description. However, such components and methods are well understood in the art of inkjet printing. In such cases a wide variety of known components and methods are suitable for use with embodiments of the present invention.

Additionally, numerous specific details are set forth in the above embodiment, in order to provide a thorough understanding of the present invention. It will, though, be apparent that the present invention may be practiced without limitation to these specific details. For example, although the above-described embodiment is described with reference to a printer, the skilled reader will appreciate that the present invention may equally be used as a printing engine for use in other hardcopy devices, such as copiers. Furthermore, although the above-described embodiment is described with reference to an inkjet printer, the skilled reader will appreciate that the present invention may equally be applied to printers that use other printing techniques in which an image is generated on or transferred to one or more rollers or drums. For example, printing techniques which employ dry electro-photography or liquid electro-photography.

Although in the above-described embodiment, the printer has five drums and five pairs of print bars, the skilled reader will appreciate that any reasonable number, greater or smaller than five, may instead by used. If, for example, additional ink colours are required such as light cyan and light magenta making a six ink system, seven sets of print bars may be used (one providing a fixer print station) and seven drums may therefore be beneficially employed. Alternatively, in a system which does not require a fixer, the number of sets of print bars and drums may be reduced to four. Other embodiments of the invention may give rise to additional flexibility in terms of the number of drums which may be employed efficiently. By using two or more print bars arranged to print different ink colours and/or ink and fixer at the same print station, the number of drums and print stations may be reduced. For example, one embodiment according to the present invention may comprise three drums and three print stations, with each print station having two print bars. The first print station may have two fixer print bars. The second print station may have a cyan and a magenta print bar. The third print station may have a yellow and a black print bar. This arrangement may provide the benefit of a cheaper printer and/or a printer with a smaller overall volume. It will thus be understood that other embodiments of the invention may employ one, two, three, or any reasonable number of print bars arranged to print the same colour ink or fixer. Print bars arranged to print the same colour ink or fixer may be located at the same or at different print stations of the printer.

In certain embodiments of the invention, printers according to the present invention may have a normal colour printing mode and a high speed black and white mode. Such a printer may, for example, have four printing stations and four drums. In the normal colour printing mode, the printer may have a single cyan print bar at the first print station; a single magenta print bar at the second print station; a single yellow print bar at the third print station; and, a single black print bar at the fourth print station. The printer may also be equipped with a sheet picking system at each of the first and the third print stations and a sheet ejecting system at each of the second and the fourth print stations. In this manner, each of the sheet picking systems is located between the two sheet ejecting systems and vice versa. During the normal colour printing mode, sheets may be loaded onto the drums only by the sheet picking system at the first print station and unloaded from the drums only by the sheet ejecting system at the fourth print station. In this manner, each sheet passes through each of the four print stations between being loaded and unloaded and thus may receive ink of each of the four colours, in the manner described more fully in the embodiment above. Thus, during the normal colour printing mode one sheet picking system and one sheet ejecting system may remain unused. During the high speed black and white mode, however, the user may replace each of the cyan, magenta and yellow print bars with a black print bar. In this configuration, the printer has four black print bars, one located at each print station. In this printing mode, sheets may be loaded onto the drums by the sheet picking system at the first print station and then unloaded by the sheet ejecting system at the second print stations. Between being loaded and unloaded, the sheets may be printed on with black ink by the print bars located at the first and/or second print station. At the same time, sheets may be loaded onto the drums by the sheet picking system at the third print station and then unloaded by the sheet ejecting system at the fourth print stations. Between being loaded and unloaded, the sheets may be printed on with black ink by the print bars located at the third and/or fourth print stations. It will thus be seen that using such a technique and configuration, the high speed black and white print mode with double the throughput of the normal colour print mode may be realised. It will be appreciated that further refinements are possible by the addition of yet further sheet picking and sheet ejecting systems. For example, by including a sheet picking system and a sheet ejecting system at each printing station, four separate monochrome sheets may be printed simultaneously. In such a configuration, it would not be necessary to index the drums between print stations in the black and white printing mode, thus giving rise to an increase in throughput of more than four times that achieved in the normal colour mode. Alternatively, by installing colour print bars at one or more of the print stations, colour and black and white pages may be printed at the same time, at different print stations of the printer.

Although the service stations of the above-described embodiment are described as containing only spittoons for collecting and storing spitted ink, the skilled reader will appreciate that in embodiments of the invention the service stations may additionally contain other components arranged to carry out other functions. For example, the service stations of further embodiments of the invention may contain a number of elastomeric wipers, used to wipe the printhead surface with an ink solvent, such as a polyethylene glycol ("PEG") compound. The wiping process may be used to remove any ink residue, paper dust, or other matter that has collected on the face of the printhead. Additionally, the service stations may include a capping system that seals and protects the printhead nozzles from contaminants and drying out during non-printing periods. Examples of service stations and their individual components that may be used in conjunction with embodiments of the present invention are disclosed in U.S. Pat. No. 6,203,135 entitled "Independent Servicing Of Multiple Inkjet Printheads", in the name of Hewlett-Packard Co., which is hereby incorporated herein in its entirety. Whilst in the above-described embodiment the service stations forms part of a single rotating assembly with the drums, the skilled reader will appreciate that in other embodiments this need not be the case. In embodiments of the present invention, the service stations could maintain a fixed rotational position relative to the print bars. In order to ensure that the service stations do not interfere with the rotation of the drums relative to the print bars, they may be held below the level of the drums during normal use. When a servicing routine is required, they may be raised to bring them into closer to the print bars. Such a raising and lowering mechanism may be usefully used to allow the print bars to be capped by capping mechanisms.

As will be understood by the skilled reader, where page wide array inkjet printers are used to print with a high throughput, one problem which may arise is to how to dry the large quantities of ink and fixer which are rapidly deposited onto the print media. In the embodiment described above, the drums are heated electrically, using conventional heating techniques. Either additionally or alternatively, further forced drying techniques may be implemented. Such techniques may include the use of infra red or convection heaters, for example. These heaters may be located between the print stations, where there is more free space. In this manner, the heaters may dry the print media as the drums pass between the print stations; i.e. during the indexing procedures. Although in the above-described embodiment the drums are not driven about their own longitudinal axes during indexing procedures, it may be beneficial to do so where heaters are used to dry the print media sheets during the indexing procedures. The constant rotation of the drums whilst indexing may help to ensure a more constant drying rate across the surface of a sheet of print media, despite the fact that the heating effect emanates from a relatively directional source.

Figure 3A:
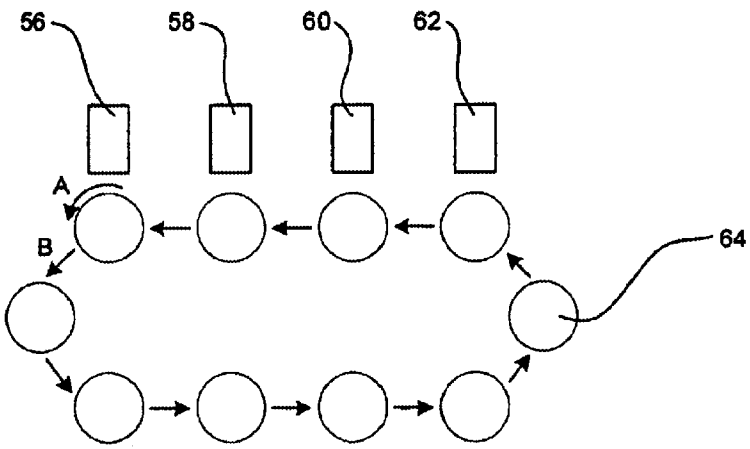
FIG. 3*a* is a schematic side elevation of an inkjet printer according to a second embodiment of the invention; and, FIG. 3*b* is a schematic side elevation of an inkjet printer according to a third embodiment of the invention.
Figure 3B:
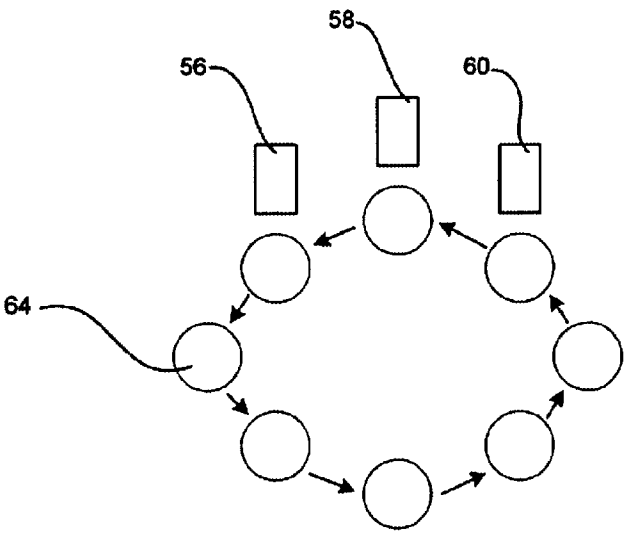

Whereas in the above-described embodiment, the drums of the printer are indexed from one print station to another following a rotary path (i.e. the drums are arranged in a manner resembling the spokes of a wheel), other embodiments of the invention may employ a different configuration. In certain embodiments of the invention, the drums may be arranged such that the longitudinal axis of each drum lies parallel to the longitudinal axis of the others. Each drum may index in a linear manner (in a direction perpendicular to its longitudinal axis) around a looped path. In this manner, the assembly of drums may resemble a continuous belt formed from drums. A side elevation of such an arrangement is illustrated schematically in FIG. 3*a*. In this embodiment a number of drums 64 (ten are illustrated in the figure) are supported between a pair of parallel plates (not shown). In this embodiment, the plates lie perpendicular to the longitudinal axes of the drums, such that the drums are free to rotate about their longitudinal axes. This is illustrated by the arrow "A" in the figure. As can be seen from the figure, the printer has four print stations 56, 58, 60 and 62. Each of the four print stations has one or more print bars of inkjet nozzles. Each of the print bars is arranged to lie parallel to the longitudinal axes of the drums 64. In this manner, as the drums are driven to rotate about their longitudinal axes, the print media supported by the drums adjacent to the four print stations may be printed on by the print bars associated with the print stations. When a printing phase is finished, the drums are indexed relative to the print stations; i.e. each drum is moved to the position vacated by the drum immediately ahead of it. The indexing motion is illustrated by the arrow "B" in the figure. In this manner, printing and indexing operations are successively repeated to ensure that the print media supported on a given drum passes under each of the print stations in turn. An embodiment of this type may in practice take up less space than that where the drums of the printer are indexed from one print station to another following a rotary path under the print bars. A further embodiment with three print stations but similar to that described with reference to FIG. 3*a* is illustrated in FIG. 3*b*. Here, the positions to which the drums are indexed are laid out in a more circular manner. This may give rise to greater space savings.

It will be noted that in the case of both FIG. 3*a* and FIG. 3*a,* in a full indexing cycle (i.e. ten indexing steps in the case of the embodiment of FIG. 3*a* and eight indexing steps in the case of the embodiment of FIG. 3*b*) each drum is indexed to a number of positions where no printing takes place. This may allow more time to load and unload media sheets from the drums, thus facilitating the loading and unloading processes. It will be appreciated that this technique of providing non-printing indexing positions to facilitate the loading and unloading processes may also be used in the case of embodiments of the present invention in which the drums follow a rotary path under the print bars about a central hub.

The skilled reader will appreciate that the various further embodiments described herein may be used in combination with one or more of the remaining further embodiments.

What is claimed is:

1. A printing device comprising first and second platens each arranged to support a media sheet, and first and second print stations having first and second print positions respectively, said device being arranged to index said platens in a predetermined order from said first to said second print position, said device being further arranged to advance a platen located in a print position relative to said corresponding print station such that said corresponding print station may print on different areas of a sheet supported on said platen, said indexing motion and said advance motion being independently controllable.

2. A device according to claim 1, wherein said device is arranged to advance said platen relative to said corresponding print station whilst there is substantially no indexing motion.

3. A device according to claim 1, wherein said first and second platens are drum platens or rollers or the like.

4. A device according to 3, wherein said platens remain substantially stationary whilst being indexed between said first and second print positions.

5. A device according to 3, wherein said first and second print stations remain substantially stationary whilst said platens are indexed between said first and second print positions.

6. A device according to claim 5, wherein said indexing motion of said platens relative to said first and second print positions is substantially linear.

7. A device according to claim 5, wherein said indexing motion of said platens relative to said first and second print positions is substantially rotary.

8. A device according to claim 7, further comprising an indexing system arranged to index said platens between said first and second print positions, said indexing system being arranged to rotate about a central hub, said platens being connected to said hub by one or more connection members.

9. A device according to claim 3, wherein said platens have a substantially cylindrical outer surface disposed about a central axis, said advance motion comprising a rotation of said platen about said central axis.

10. A device according to claim 3, wherein said platens are formed from a plastic moulding.

11. A device according to claim 1, wherein said first or said second print station comprises one or more page wide arrays of inkjet nozzles.

12. A device according to claim 1, further comprising one or more further platens, said device being arranged to sequentially index said first and second and said further platens between said first and second print positions.

13. A device according to claim 1, further comprising one or more further print stations, each further printing station having a corresponding print position, said device being arranged to index said platens to said print positions of said one or more further print stations.

14. A device according to claim 1, arranged to print substantially simultaneously with said first and second print stations on first and second first media sheets supported on said first and second platens respectively.

15. A device according to claim 1, arranged to print different colour separations of an image on a given sheet of print media at different print stations.

16. A printing device comprising a plurality of drums each arranged to support a print media sheet, said device being arranged to transport said drums in a predetermined order around a closed path comprising a plurality of print positions, said device being arranged to print at each print position with a different inkjet print bar, said device being further arranged to rotate a drum located in a print position relative to said corresponding print bar to allow said print bar to incrementally print over the surface of a sheet supported on said drum.

17. A device according to claim 16, said device being arranged to load and unload a sheet from a drum at alternative locations in said closed path, such that a sheet may be transported through more print positions in a first print mode than in a second print mode.

18. A device according to claim 17, wherein said second mode is a high speed printing mode and said first mode is a reduced speed printing mode.

19. A device according to claim 17, wherein said second mode is a monochrome printing mode and said first mode is a colour printing mode.

20. A device according to claim 17, wherein said print bars are replaceable in dependence upon the printing mode.

21. A device according to claim 16, said device being arranged to rotate said drum relative to said corresponding inkjet print bar two or more substantially complete rotations at a given print position prior to indexing said drum to the next print position, thus allowing a multi-pass print mode to be implemented.

22. A device according to claim 16, said device being arranged to transport a sheet more than one complete cycle around said path, thus allowing a multi-pass print mode to be implemented.

23. An incremental printing device comprising first and second printing stations and a drum arranged to support a sheet of print media, the drum being arranged to translate between first and second printing positions adjacent to said first and second printing stations respectively and being further arranged whilst in a printing position to rotate relative to said adjacent printing station such that said adjacent printing station may print on different areas of said sheet.

24. A method of operating a page wide array inkjet printer, said printer comprising first and second print bars having respective first and second printing positions and a drum platen arranged to support a sheet of print media, comprising:

whilst said platen is located in said first printing position, rotating said platen relative to said first printing station, such that said first printing station may print on different areas of said sheet; and, with a motion decoupled from said rotating said platen, moving said platen to said second printing position.

25. A method according to claim 24, wherein said printer further comprises a service station, said method comprising servicing said first or said second print bar during said moving step.

26. A method according to claim 24, comprising printing a different colour separation of an image on said sheet with each of said first and said second print bars.

27. A method according to claim 24, wherein in rotating said platen, said platen is rotated an angular distance sufficient such that said sheet makes more than one pass past said first print bar, without an intervening movement being implemented.

28. A method according to claim 24, comprising printing on said sheet with said first print bar, then with said second print bar, and then again with said first print bar.

29. A computer program comprising program code for performing the method claim 24 when said program is run on a processing device associated with a suitable printer device.

* * * * *